United States Patent [19]

Feld et al.

[11] Patent Number: 4,534,994

[45] Date of Patent: Aug. 13, 1985

[54] PROCESS FOR MAKING FINE PERFORATIONS IN PLASTIC SHEETING AND/OR PLASTIC OR RUBBER COATED SHEET MATERIALS

[76] Inventors: Gerhard Feld, Am Erl-Anger 3, 8501 Eckenthal; Klaus-Peter Schmidt-Kufeke, Bernhardstr. 5, 7500 Karlsruhe 1, both of Fed. Rep. of Germany

[21] Appl. No.: 608,023

[22] Filed: May 3, 1984

[30] Foreign Application Priority Data

May 3, 1983 [DE] Fed. Rep. of Germany ..... 3316118

[51] Int. Cl.[3] ..... B05D 3/14

[52] U.S. Cl. ..... 427/37; 427/245; 427/289; 219/384

[58] Field of Search ..... 427/37, 39, 40, 245, 427/289; 428/262, 315.5; 219/384

[56] References Cited

U.S. PATENT DOCUMENTS

| | | | |
|---|---|---|---|
| 2,055,002 | 9/1936 | Chandler | 427/245 |
| 2,994,617 | 8/1961 | Proctor | 427/245 |
| 3,307,961 | 3/1967 | Stiehl et al. | 427/289 |
| 3,656,988 | 4/1972 | Steffen et al. | 427/289 |
| 4,064,386 | 12/1977 | Numrich | 427/37 |
| 4,278,871 | 7/1981 | Schmidt-Kufeke et al. | 219/384 |

*Primary Examiner*—John H. Newsome
*Attorney, Agent, or Firm*—Michael J. Striker

[57] ABSTRACT

A process for making fine perforations in plastic sheeting and/or plastic or rubber coated sheet materials in which the sheeting or the coating is too thick and/or the dielectric constants are too high for electrically making the fine perforations, including the steps of coarsely perforating the material by non-electrical methods, coating the perforated material with a layer of a coating material which is capable of being electrically perforated, and making fine perforations in the layer of the coating material by the use of high-voltage pulses.

9 Claims, 3 Drawing Figures

PROCESS FOR MAKING FINE PERFORATIONS IN PLASTIC SHEETING AND/OR PLASTIC OR RUBBER COATED SHEET MATERIALS

BACKGROUND OF THE INVENTION

The present invention relates to a process for introducing perforations into plastic sheeting and/or plastic or rubber coated sheet materials. More particularly, it relates to a process for introducing perforations into plastic sheeting and/or plastic or rubber coated sheet materials by the use of electricity.

Processes for introducing perforations into plastic sheeting and/or plastic or rubber coated sheet materials of the above mentioned general type are known in the art. Plastic sheeting and plastics or rubber coated textiles, such as artificial leather or waterproofed clothing, have the advantage of being absolutely waterproof. However, they have the disadvantage of either having little or no capabilities for breathing. For various practical applications, such as in the clothing industry, such materials are required to have a certain degree of water vapor permeability while simultaneously having a high degree of water proofness. The water vapor permeability chiefly depends on the number and absolute size of the perforations per unit of surface area.

The German Published patent application (DE-OS) No. 28 30 326 discloses an arrangement for making the fine perforations in sheet-like materials with the aid of high voltage pulses. These high voltage pulses provide uniform and dense perforations. The perforations comply with the standard specifications by maintaining smallest perforation hole diameter which provides both sufficient breathing and a high degree of water proofing of the perforated material.

There are, however, quite a number of materials which are processed into sheeting or used as laminated sheets, such as polyethylene, polypropylene, and natural and synthetic rubber. These materials have a high dielectric constant and therefore make the use of electricity, aided by high-voltage pulses, for creating the perforations impossible. However, in individual cases, by increasing the voltage applied, it is possible to achieve a puncturing or piercing of the material. The resulting holes are as a rule so large that waterproofing can not be provided. The same problem arises from a certain sheet or layer thickness of the material which would be suitable for the electric perforation.

SUMMARY OF THE INVENTION

Accordingly, it is an object of the present invention to provide a process for introducing fine perforations into plastic sheeting and/or plastic or rubber coated sheet materials which avoids the disadvantages of the prior art.

More particularly, it is an object of the present invention to provide a process for introducing fine perforations into plastic sheeting and/or plastic or rubber coated sheet materials or into materials which cannot be perforated electrically or in doing so create difficulties, so that the material can breath while still remaining waterproof.

In keeping with these objects, and with others which will become apparent hereinafter, one feature of the present invention resides, briefly stated, in a process for making fine perforations in plastic sheeting and/or plastic or rubber coated sheet materials in which the sheeting or the coating is too thick and/or the dielectric constants thereof are too high for making the fine perforations with the aid of high voltage pulses, including the steps of perforating the material and coating the perforated material with a layer of a coating material which is capable of being electrically perforated wherein fine perforations are made in the layer of the coating material by the use of high voltage pulses.

When the process is designed in accordance with the present invention there is provided a simple method of making fine perforations in materials which would normally be unsuitable therefor.

In accordance with another feature of the present invention, the step of perforating the material is performed mechanically.

Still another feature of the present invention is that the layer of the coating material is thin and homogeneous.

A further feature of the present invention is that the coating material is plastic.

Yet another feature of the present invention is that the step of perforating the material is performed mechanically with the aid of needles.

Still another feature of the present invention is that the step of coating the perforated material with a layer of the coating material is accomplished by using coating means.

Yet still another feature of the present invention is that the coating means is spraying.

Still yet another feature of the present invention is that the coating material is deposited as a liquid onto the material.

Finally, still a further feature of the present invention is that the coating material is deposited in a paste like form onto the material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
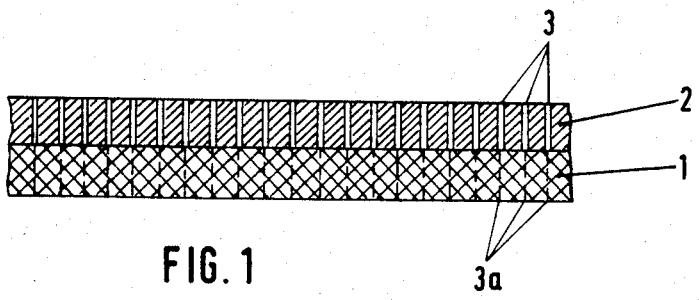
FIG. 1 is an enlarged sectional side view showing in a needled state part of a textile backing material with a plastic sheeting coated thereon.

Referring now to FIG. 1 where it is shown on an enlarged scale a part of a sheet material which has a textile material base 1 to which a plastic sheeting 2 is bonded. The plastic sheeting 2 is incapable of being electrically perforated. Depending on its intended application, the textile material base may be replaced by any other suitable breathing base, such as a fleece or a paper. It is also possible to do without such a base.

The sheet bonded (laminated) textile material base 1 as shown in FIG. 1 has already completed a first processing step in which it was provided with fine perforations employed by machanical means utilizing a known needling process. Through this needling process, the plastic sheeting 2 is provided with a plurality of closely adjacent perforations (or holes) 3. Also, in the course of this process, the textile material base 1 is perforated with perforations (or holes) *3a*. Because of the looseness of the textile material base 1, the perforations *3a* are lost. The perforations 3, when using the finest needle, have a dimeter sufficient to provide good breathing. However, the perforations 3 do not assure waterproofing.

During the second processing step, the surface of the plastic sheeting 2 is coated with a thin closed (unperforated or uninterrupted) layer 4 of a material capable of being electrically perforated. The layer 4 is preferably composed of a plastic material. The layer 4 is sprayed on in a known manner either in a liquid or paste-like form, or may be deposited on the plastic sheeting 2 by means of a coating mechanism.

After the layer 4 has set and solidified, the entire sheet material is subjected to a third processing step in which fine perforations are introduced. The third processing step may be performed, for example, with the aid of an arrangement according to DE-OS No. 28 30 326, in which the layer 4 is provided with fine pores 5 in the area of the holes 3. Depending upon the diameter of each hole 3, either one or more pores 5 can be made for each hole 3.

Figure 2:
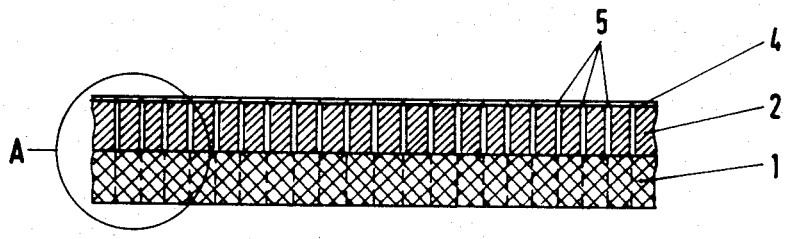
FIG. 2 is the enlarged sectional side view shown in FIG. 1 and further showing the surface of the sheeting coated with a thin layer of a material capable of being electrically perforated.
Figure 3:
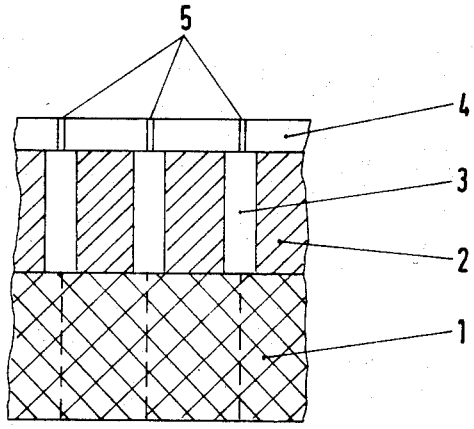
FIG. 3 is an enlarged sectional side view of detail A of FIG. 2.

In FIG. 3 the detail A of FIG. 2 is shown on an enlarged scale which better discloses the needled plastic sheeting 2 containing the holes 3. The holes 3 are covered on their outside by the layer 4. Because of the fine pores 5 made in the layer 4, there is assured the desired breathing while simultaneously providing for a high degree of water proofing.

It will be understood that each of the steps described above, or two or more together, may also find a useful application in other types of processes differing from the types described above.

While the invention has been illustrated and described as embodied in a process for making fine perforations in plastic sheeting and/or plastic or rubber coated sheet materials, it is not intended to be limited to the details shown, since various modifications and stepwise changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Process for making fine perforations in plastic sheeting and/or plastic or rubber coated sheet materials in which the sheeting or the coating is too thick and/or the dielectric constants thereof are too high for making the fine perforations by electrical pulses, comprising the steps of:

coarsely perforating the material by other means;

coating the perforated material with a layer of a coating material which is capable of being electrically perforated; and making fine perforations in the layer of the coating material by the use of high-voltage pulses.

2. The process as defined in claim 1, wherein said step of perforating the material includes mechanically perforating the material.

3. The process as defined in claim 1, wherein said coating step includes coating with a thin homogeneous layer of the coating material.

4. The process as defined in claim 1, wherein said coating step includes coating with a plastic coating material.

5. The process as defined in claim 2, wherein said step of perforating the material includes perforating the material mechanically with the aid of needles.

6. The process as defined in claim 1, wherein said step of coating the perforated material with a layer of the coating material includes coating by using coating means.

7. The process as defined in claim 1, wherein said coating step includes coating by spraying.

8. The process as defined in claim 1, wherein said coating step includes depositing the coating material as a liquid onto the material.

9. The process as defined in claim 1, wherein said coating step includes depositing the coating material in a paste like form onto the material.

* * * * *